United States Patent [19]

Cavazza

[11] 4,346,820

[45] Aug. 31, 1982

[54] APPARATUS FOR MIXING AND DISPERSING TWO SUBSTANCES UNDER STERILE CONDITIONS

[75] Inventor: Claudio Cavazza, Rome, Italy

[73] Assignee: Sigma-Tau Industrie Farmaceutiche Riunite, Italy

[21] Appl. No.: 145,977

[22] Filed: May 2, 1980

[30] Foreign Application Priority Data

May 2, 1979 [IT] Italy ..... 48916 A/79

[51] Int. Cl.[3] ..... A61J 1/00

[52] U.S. Cl. ..... 222/83; 206/222; 206/420; 285/235; 285/DIG. 22

[58] Field of Search ..... 206/222; 285/235, 319, 285/322, DIG. 22; 141/329, 330, 364, 366, 383; 128/218 M, 272, 272.1, 272.3; 222/80, 83, 89, 420

[56] References Cited

U.S. PATENT DOCUMENTS

| | | | |
|---|---|---|---|
| 2,818,864 | 1/1958 | Hudson | 128/272 |
| 3,872,867 | 3/1975 | Killinger | 128/272 |
| 4,170,994 | 10/1979 | Komatsu | 128/272 X |

FOREIGN PATENT DOCUMENTS

| | | | |
|---|---|---|---|
| 296153 | 6/1967 | Australia | 222/420 |
| 1545963 | 10/1968 | France | 206/222 |
| 2293916 | 7/1976 | France | 206/222 |
| 2302134 | 7/1976 | France | 141/329 |

*Primary Examiner*—David A. Scherbel
*Attorney, Agent, or Firm*—McGlew and Tuttle

[57] ABSTRACT

An apparatus for extemporaneously mixing two substances and dispensing the resulting mixture is disclosed, wherein the container for the solvent and the container for the substance to be dissolved are sealingly and removably retained in superimposed position by a sleeve provided with and axially-extending, substantially cylindrical transfer spout the outwardly projecting end whereof is shaped as a piercing tip and having therein two parallel, adjacent passages. The opposite outlets of one passage are offset to the corresponding outlets of the adjacent passage.

4 Claims, 4 Drawing Figures

APPARATUS FOR MIXING AND DISPERSING TWO SUBSTANCES UNDER STERILE CONDITIONS

FIELD AND BACKGROUND OF INVENTION

The present invention relates to an apparatus for mixing and dispensing two substances.

More particularly, the present invention relates to an apparatus for mixing, when required for use, a liquid solvent with either a solid or liquid substance to be dissolved in the solvent, storing the solution thus obtained and dispensing dosed amounts of the solution, under sterile conditions.

The present invention specifically tackles the problem of extemporaneously preparing and dispensing dosed amounts of pharmaceutical preparations which result from the extemporaneous mixing of a liquid solvent, which is kept in a first container, with a pharmaceutical substance or drug in powder or liquid form, kept in a second container, the pharmaceutical substance being mixed with or dissolved in the solvent when required for use.

It is known that difficulties are often encountered when a liquid (e.g. a solvent) kept in a first sealed container is to be transferred under aseptical conditions into a second container which is also sealed, wherein a substance in solid or liquid form is placed. This situation occurs particularly in the pharmaceutical art wherein solutions, suitable for intravenous or oral administration are often extemporaneously prepared directly by the user by mixing a liquid solvent with a liquid or solid pharmacologically active agent, both the solvent and the active agent being stored separately in distinct containers up to the moment of mixture preparation.

Several devices have been disclosed, which are provided with pumping means for carrying out the transfer of a liquid solvent from a first sealed container into a second sealed container under aseptical conditions. These devices are costly and cumbersome and frequently do not afford satisfactory results.

It has been also proposed to keep one of the containers under vacuum, so that the vacuum causes, when the containers are connected to each other by means of a double-tipped, hollow needle inserted through the rubber plugs of both containers placed in superimposed relationship, the passage of the liquid solvent to occur from the container at atmospheric pressure into the container under vacuum. Also these arrangements have proved to be costly and cumbersome.

More recently, in order to overcome the foregoing drawbacks, in the U.S. patent application Ser. No. 045,165 filed June 4, 1979, now U.S. Pat. No. 4,244,467, in the name of the same assignee as this application, an apparatus for mixing and dispensing two substances has been disclosed which comprises, in combination, a first container, a second container, a plug seated in the neck of the second container and having a recess which is open in the upward and outward direction, and an elongated transfer spout secured in the base of the recess and projecting both inwardly into and outwardly from the second container. The spout is provided with two substantially parallel passages extending therethrough. The passage openings are located at different heights by the provision of bevelled end surfaces on the transfer spout.

SUMMARY OF THE INVENTION

It has now been found that the foregoing apparatus can be further improved by providing in combination with a first container for containing a first substance in a sealed manner, the first container having a neck defining a discharge opening and being sealable by a stopper, and a second container for containing a second substance in a sealed manner, the second container having a neck defining a discharge opening, a sleeve dimensioned to receive into one end thereof the neck of the first container in a sealed manner and into the opposite end thereof the neck of the second container, and having intermediate said opposite ends a transversally extending, peripherally continuous septum provided with a centrally positioned opening.

An elongated transfer spout having a first end to project into the second container and a second end to enter the first container through the stopper, is also provided with the transfer spout having a portion intermediate the first and second ends sealably retained in the septum opening and being provided with two substantially parallel passages extending longitudinally therethrough. The first and second ends of the transfer spout are bevelled whereby the respective ends of the substantially parallel passages open into the bevelled ends at different longitudinal locations. The bevelled second end of the transfer spout provides a piercing tip.

A preferred embodiment of apparatus according to this invention is now illustrated with reference to the annexed drawings.

DESCRIPTION OF THE PREFERRED EMBODIMENT

Figure 1:
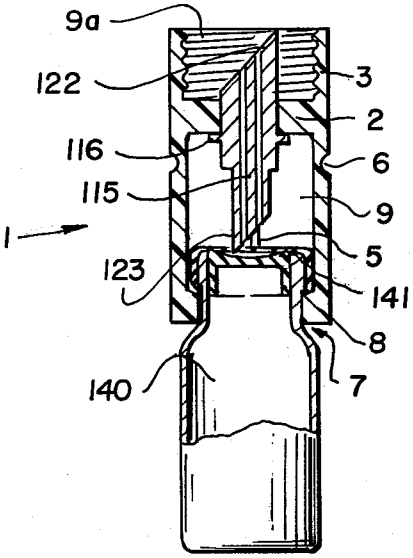
FIG. 1 is an axial, partly elevational and partly sectional view of the first container (an ampule) and the sleeve engaged thereto.
Figure 3:
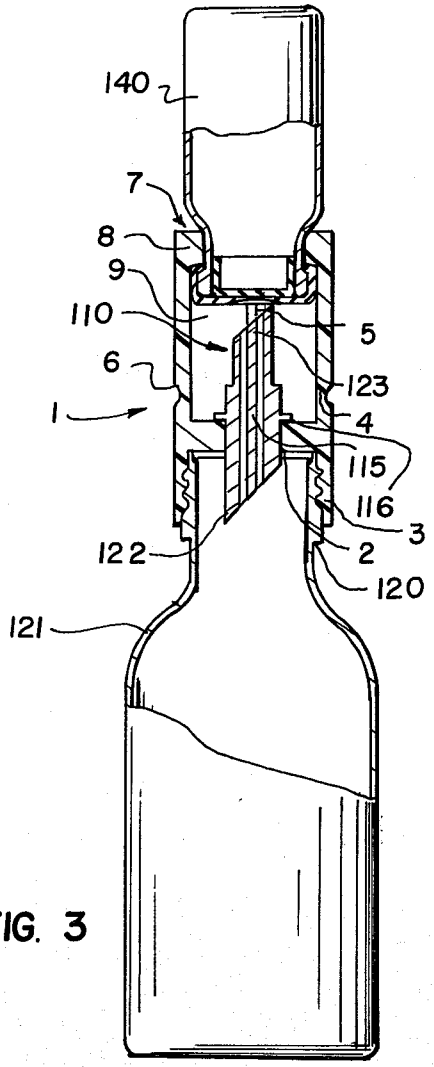
FIG. 3 is an axial, partly elevational and partly sectional view of the ampule-bottle assembly engaged to each other in superimposed position, ready for the piercing operation to be carried out.

With specific reference to FIGS. 1 and 3, a sleeve 1 comprises a cylindrical hollow body having therein a circular, transversally-extending partition wall or septum 2. The septum 2 divides the sleeve 1 into two portions or sections 3,4 which define corresponding recesses *9a*, 9. Section 3 is internally screw-threaded. Section 4 presents therein four longitudinally extending cuts (only one of them can be seen in FIG. 4), angularly distanced by 90° from each other, which run from an outer, circular, peripherally extending groove 6 to the inlet mouth 7 of section 4. The inlet mouth 7 presents an inner, peripherally extending lip 8 which narrows the inlet mouth 7 in such a way that its inner diameter is slightly smaller than the outer diameter of the plug 141 of the ampule 140 to sealingly retain the ampule in axial relationship with the sleeve. The septum 2 presents a centrally-positioned opening in which an elongated transfer spout 110 is sealingly retained. The transfer spout 110 has a first end 123 projecting into the recess 9 and a second end 122 projecting into recess 9*a*. As shown in FIGS. 1, 3, the transfer spout 110 is also provided with two substantially parallel passages extending longitudinally therethrough. The ends 122, 123 of the transfer spout are bevelled whereby, as clearly shown in FIGS. 1, 3, the respective ends of the substantially parallel passages open into the bevelled ends at different longitudinal locations. As will be herein illustrated in detail with reference to the operation of the apparatus of this invention, the bevelled end 123 projecting into the recess 9 provides a piercing tip for the plug 141 of the ampule 140.

As clearly shown in FIGS. 1, 3 when the neck of the ampule 140 is fitted into the inlet mouth 7 of the sleeve 1 the piercing tip provided by the bevelled end 123 stops short of the rubber plug 141.

Figure 2:
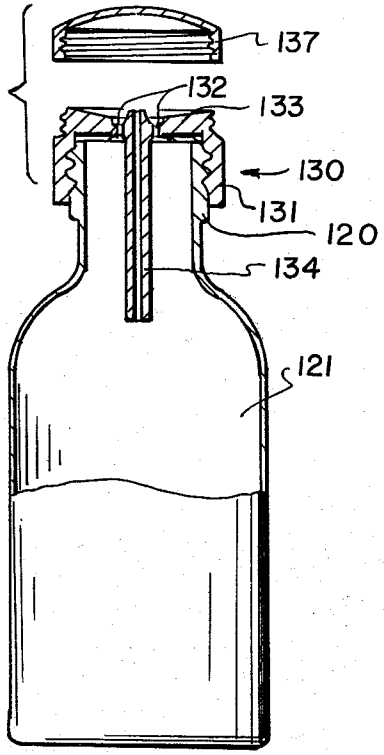
FIG. 2 is an axial, partly elevational and partly sectional view of the second container (a bottle) containing the solution liquid, provided with the improved drop dispensing device.

With reference now to FIG. 2, a bottle 121 which shall subsequently serve as dispensing container for the solution obtained by dissolving the contents of the ampule 140 (e.g. a drug in powder form) in the contents of the bottle 121 (e.g. a solvent for the drug) has a neck 120 defining a discharge opening, which is externally screw-threaded to mate with the internally screw-threaded section 3 of the sleeve 1. A drop dispensing device 130 comprising a base 133 and upstanding side walls 131 internally screw-threaded, is matingly screwed onto and over the neck 120.

The drop dispensing device 130 also comprises a longitudinally extending tube 134, centrally positioned to and integral with the base 133. The base 133 presents a number (e.g. four) of passing-through holes 132, in general simmetrically positioned around the tube 134 (only two holes 132 can be seen in FIG. 2). As shown in FIG. 2, when the drop dispensing device is screwed in position onto and over the neck 120, the tube 134 projects inside the bottle 121. The upper part of the walls 131 are externally screw-threaded to mate with the internally screw-threaded wall of a closing cap 137.

The apparatus of the present invention shall be sold in the form of a package comprising:

(a) the bottle 121 containing for instance a solvent liquid, provided with the drop dispensing device 130 and closed by the cap 137, optionally protected by a tearable metal cap (not shown);

(b) the ampule 140 containing for instance the substance to be dissolved in the solvent liquid, closed by the rubber plug 141, which is protected by a tearable metal cap (not shown); and (c) the sleeve 1 which, optionally, can be already fitted onto the neck of the ampule 140, as shown in FIG. 1.

In operation:

After tearing off the tearable protective caps, the neck of the ampule 140 is fitted into the inlet mouth 7 of sleeve 1 (FIG. 1), then the cap 137 and the drop dispensing device 130 are unscrewed and removed from the neck 120 of the bottle 121. Subsequently, section 3 of sleeve 1 is screwed onto the neck 120 of the bottle 121, the apparatus thus being in the situation shown in FIG. 3.

The ampule 140 will be then plunged downwardly until the piercing tip 123 of the transfer spout 110 pierces the rubber plug 141 thus penetrating inside the ampule 140.

Figure 4:
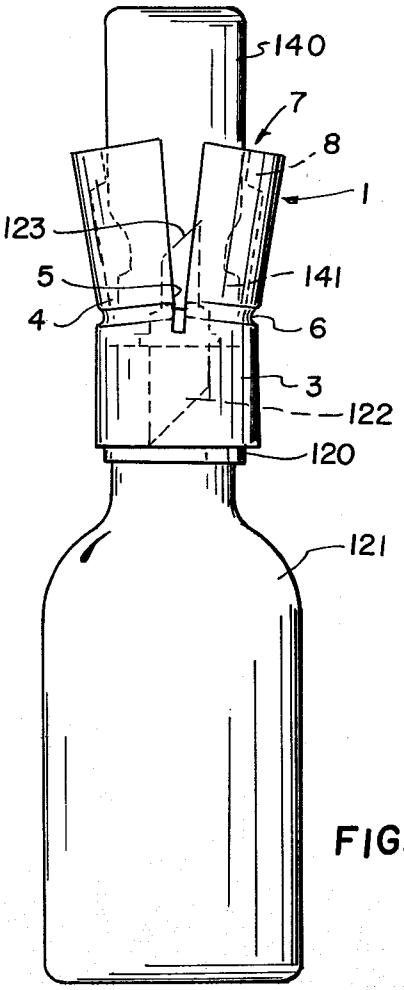
FIG. 4 is an elevational view of the assembly of FIG. 3, after the piercing of the ampule plug by the transfer device and ready for the transfer operation to be carried out.

With reference to FIG. 4, it will be noted that the advancement of the ampule 141 into the sleeve is favored by the cuts 5 and the groove 6.

By overturning the whole assembly (as shown in FIG. 3 except that the plug 141 is pierced and the spout end 123 projects inside the ampule 140), the liquid solvent stored in the container 121 (which is now located above the ampule 140) will pass into ampule 140 and the attendant mixing of the substance in this latter container with the solvent in the bottle 121 will then occur.

When the container 140 is sufficiently filled with the liquid solvent of container 121, the user will once again overturn the assembly consisting of the superimposed containers (thus bringing it back to the position shown in FIG. 4). Consequently, the solution in ampule 140 will now pass into the container 121.

At this point the sleeve 1 and the ampule 140 will be disposed of by the user and the drop-counting device 130 will be screwed into its position.

As concerned the theory of the operation of this transfer spout 110, it is believed that because of the offset position of the passage ends, there is a different hydrostatic pressure which "triggers" the flow of the solvent, due to its gravity, from the container 121 to container 140.

The flow thus achieved continues very steady, until all the solvent has passed into the container 140.

What is claimed is:

1. Apparatus for mixing and dispensing two substances comprising in combination:

a first container for sealingly containing a first substance, said first container having a neck of reduced diameter defining a discharge opening and being sealed by a stopper, said container neck with its stopper having a large diameter portion;

a second container for sealingly containing a second substance, said second container having a neck defining a discharge opening;

a sleeve dimensioned to sealingly receive into one end thereof the neck of the first container and into the opposite end thereof the neck of the second container, and having intermediate said opposite ends a transversely extending, peripherally continuous septum provided with a centrally positioned opening, said one end of said sleeve having an inwardly extending lip engaged behind said large diameter portion;

an elongated transfer spout having a first end to project into the second container and a second end to enter the first container through said stopper, said transfer spout having a portion intermediate said first and second ends sealingly retained in said septum opening and being provided with two substantially parallel passages extending longitudinally therethrough, the first and second ends of the transfer spout being bevelled so that the respective ends of the substantially parallel passages open into the bevelled ends at different longitudinal locations, wherein the bevelled second end of the transfer spout provides a piercing tip, and wherein said inwardly extending lip maintains said piercing tip from piercing engagement with said stopper of said first container before said first container is slid axially toward said piercing tip to allow mixing of the two container contents.

2. An apparatus according to claim 1, wherein said sleeve includes a first recess at said one end of said sleeve for receiving said neck of said first container, said first end of said sleeve including an outer annular groove and a plurality of longitudinal slots, said first container having a second large diameter portion on a side of said first container opposite said first mentioned large diameter portion from said first container neck, said lip of said sleeve first end being positioned on said neck between said first mentioned and second large diameter portions with said second end of said transfer spout in the vicinity of said first container stopper before said first end of said transfer spout pierces said first container stopper, whereby said first container is slidable toward said transfer spout so that said second end of said transfer spout pierces said first container stopper and said slots of said sleeve first end expand so that said lip of said sleeve can accommodate said second large diameter portion of said first container.

3. An apparatus according to claim 2, wherein said opposite end of said sleeve includes internal threads, said neck of said second container including external threads threaded to said internal threads of said sleeve opposite end with said transfer spout first end projecting into said second container.

4. Apparatus as claimed in claim 1, further comprising a drop dispensing device removably seatable on the neck of the second container, the drop dispensing device comprising a plug-like member having a base and a peripherally continuous wall depending therefrom, a longitudinally extending tube, centrally positioned to and integral with the base, wherein the base presents a number of passing-through holes positioned around said tube.

* * * * *